US006523265B2

(12) United States Patent
Eickhorn

(10) Patent No.: US 6,523,265 B2
(45) Date of Patent: Feb. 25, 2003

(54) CLASP KNIFE

(76) Inventor: Jörg Eickhorn, Brend'amour Str. 21, D-40545 Düsseldorf (DE)

( * ) Notice: Subject to any disclaimer, the term of this patent is extended or adjusted under 35 U.S.C. 154(b) by 0 days.

(21) Appl. No.: 09/918,290

(22) Filed: Jul. 30, 2001

(65) Prior Publication Data

US 2002/0029481 A1 Mar. 14, 2002

(30) Foreign Application Priority Data

Aug. 3, 2000 (DE) ..... 200 13 424 U

(51) Int. Cl.[7] ..... B26B 1/04
(52) U.S. Cl. ..... 30/161; 30/155
(58) Field of Search ..... 30/155, 158, 160, 30/161

(56) References Cited

U.S. PATENT DOCUMENTS 1,265,723 A * 5/1918 Bader ..... 30/161
5,093,995 A * 3/1992 Jan ..... 30/161
5,685,079 A * 11/1997 Brothers et al. ..... 30/161
5,822,866 A * 10/1998 Pardue ..... 30/161
6,363,615 B1 * 4/2002 Moser ..... 30/161

* cited by examiner

*Primary Examiner*—Hwei-Slu Payer
(74) *Attorney, Agent, or Firm*—Schweitzer Cornman Gross & Bondell LLP

(57) ABSTRACT

The invention discloses a knife having a blade which is rotatably connected to a handle so that the blade can be folded into the handle and folded out of the handle. The knife has a locking means by which the blade can be locked or unlocked when the blade is folded into the handle. The locking means includes a rotatable pin which is accessible from the exterior and which is disposed in the handle of the knife.

8 Claims, 3 Drawing Sheets

CLASP KNIFE

BACKGROUND AND SUMMARY OF THE INVENTION

The invention concerns a knife having a handle and a blade.

A blade has a side 9 which is ground sharp, referred to as the cutting edge. The cutting edge serves for cutting articles.

The object of the invention is to provide a knife having improved properties in relation to the above-indicated state of the art.

In accordance with the disclosed invention the knife has a blade which is connected rotatably to the handle. Provided in the handle is a slot into which the blade can be pivoted or folded. When the blade is folded into the handle it can be folded out of same. There are two limit positions. The one limit position is reached when the blade is folded into the handle. The other limit position is reached when the blade is folded out of the handle to such an extent theat the blade substantially forms a straight line with the handle.

Advantageously the knife has a locking means by which the blade can be locked or unlocked when the blade is folded into the handle. Locking or in locking in the above-indicated sense occurs when that is possible by manual actuation of the locking means. The locking means can therefore be moved manually into two positions. In the first position, the folded-in blade is locked. If then the locking means is suitably manually actuated, that locking action is then released. The blade can then be pivoted out of the handle without having to act on the locking means again.

The provision of a locking means in the above-indicated manner can operate in particular as a child-proofing means. In the folded-in condition the cutting edge, that is to say the sharp side of the blade, is covered by the handle. The cutting edge is then no longer accessable from the exterior. The fact that the end position of the blade is then locked affords additional protection from improper handling. Improper handling and injuries that this entails are to be feared in particular if a knife as claimed falls into the hands of small children. If then the blade is locked in the folded-in condition, a small child cannot readily fold the blade out of the handle and inflict injuries on himself or others, with the sharp cutting edge.

In an advantageous embodiment the above-mentioned locking means for locking the blade in the folded-in condition includes a rotatable pin which is accessible from the exterior and which is disposed in the handle of the knife. The pin has a opening. The blade also has a opening. The two openings are so matched to each other that the opening in the pin is in the opening in the blade when the blade is folded into the handle. In addition the two openings are such that the folded-in blade is either locked or unlocked by rotation of the pin.

The design configuration of the above-indicated locking means is simple to produce. In addition rotation of the pin, in particular if it is only of a small diameter, requires a certain amount of manual dexterity to rotate it. As a certain degree of manual dexterity is required for unlocking the blade, it is usually not possible or scarcely possible for a small child to unlock a locked, folded-in blade. The child-proofing effect is then particularly reliable.

An advantageous configuration of the invention provides a fixing means which so fixes the pin that, to unlock the blade, it is necessary to apply a force which is greater than the force which is to be applied for turning the pin. In that way the pin is protected from inadvertent rotation. The intended safeguarding effect is further improved in that way.

The fixing means is embodied in a particularly simple manner by a projection or tongue 7 which engages into a groove 6 when the blade which is folded into the handle is locked. The pin then has for example the groove. The tongue corresponding thereto is desirably disposed in the interior of the opening in the blade. The position and size of the groove and the tongue are so matched to each other that they are in mutually latching relationship in the locked, folded-in condition of the blade.

In a further improved configuration of the invention the pin is admittedly accessible from the exterior, but it is sunk in the handle. That is intended to mean that it does not project from or out of the handle. A separate tool is then required for turning the pin. A small child can only actuate the pin when that tool is available to the child. That further improves the desired child-proofing effect.

At its end which is accessible from the exterior the pin has in particular a slot which is preferably matched to the thickness of a conventional coin. Thus an adult can use a coin from his purse in order either to lock or unlock a folded-in blade. A coin is usually immediately available to an adult. This means that actuation of the locking means is not hindered by virtue of the fact that the desired tool is not available at the crucial moment. As a small child does not usually have a coin available, that ensures the safety aspect.

In a further advantageous configuration of the invention the knife includes a loop or bow member which is connected rotatably to the handle and slidably to the blade. The bow member covers the joint of the knife when the blade is folded into the handle. The joint of the knife means the region which is formed by the rotatable connection between the blade and the handle. When the blade is extended the bow member then projects on the side of the knife which is opposite to the cutting edge of the blade.

When the blade is extended from the handle, the projecting bow member thus serves as a thumb support and as a means for preventing the hand slipping off. When the knife is held at the handle, then pressure can be applied to the bow member for example with the thumb and in that way pressure can also be applied to the blade. The bow member prevents the thumb from sliding along the blade. This prevents the hand from slipping off and thus avoids a possible risk of injury.

When the blade is folded into the bow member, the latter serves as a dust protection for the joint. The mechanically movable parts, that is to say the rotatable connection between the blade and the handle, are thus protected from fouling in an improved fashion.

In order to connect the bow member slidably to the blade, a slot is provided in the blade. The bow member extends laterally of the blade as far as the slot. In the region of the slot the bow member has a pin which passes into the slot. In that way, on the one hand, a connection is made between the bow member and the blade. On the other hand, the pin can be displaced along the slot so that the connection between the bow member and the blade is slidable in accordance with the invention. The slot is so disposed that the blade can be folded unimpededly into the handle, without in that case being blocked by the bow member being fixed to the blade.

The maximum width of the bow member advantageously substantially corresponds to the width of the handle. The term width of the handle is used to denote the extent of the handle, which is shown in the section in FIG. 4. The width of the bow member is adapted to the handle in order in that way to afford a nice pleasing appearance, to provide secure slip-off protection for the thumb and to reliably afford protection from dust when the blade is folded in.

When the blade is completely extended, an advantageous configuration of the invention provides a further locking means which locks the blade in the extended position. For that purpose the blade has in particular an opening into which engages a blocking element which is connected to the handle. The blocking element is urged into the opening by means of spring force. In order to unlock the assembly, it is necessary to depress a button against the spring force. There is also provided an adjusting means with which the biasing of the spring can be altered.

It is thus possible to individually adjust the force with which the button has to be depressed in order to unlock the blade in the extended condition thereof. The adjusting means can comprise a pin with an opening. The spring presses against the opening. When the pin is rotated, the spring stress is altered in that way. It is thus possible to take account of individual requirements.

The pin for adjustment of the spring force is sunk in the handle and is accessible from the exterior. That pin is also preferably rotated by way of an auxiliary means. That therefore avoids inadvertent adjustment of the spring force. Once again, the pin is in particular so designed that it can be rotated by means of a coin. For that purpose, it has a suitably large slot at the end which is accessible from the exterior.

DESCRIPTION OF THE PREFERRED EMBODIMENT

The invention is described in greater detail by means of an example with reference to FIGS. 1 to 5 hereinafter.

Figure 1:
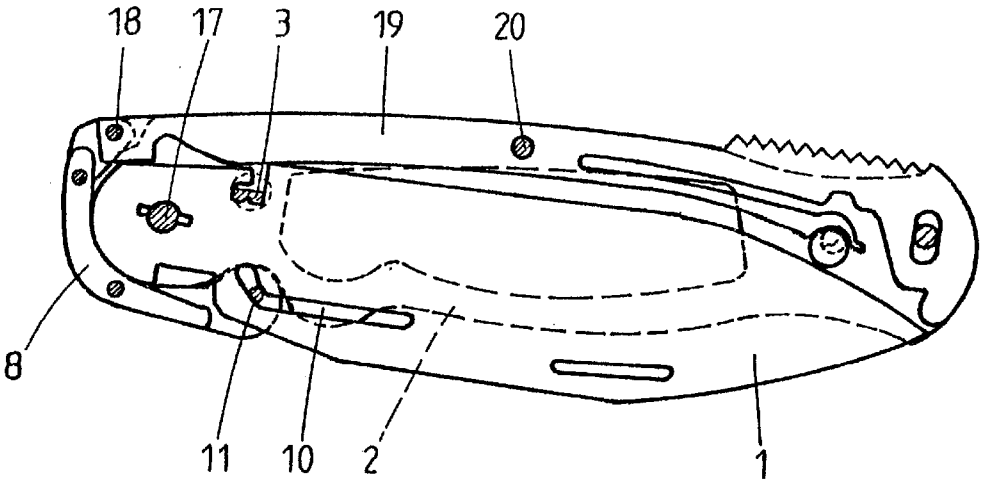
FIG. 1 shows a knife according to the present invention with the blade in a closed position.

FIG. 1 shows a knife comprising a blade 1 and a handle 2. The blade 1 is folded into the handle. Casing portions of the handle 2 are then disposed on the right and on the left of the blade. The cutting edge of the blade is sunk or recessed in the handle of the knife. A pin 3 has an opening. That region is in an opening in the blade. The opening in the blade is of such a configuration that rotation of the pin 3 prevents the pin from leaving the opening. FIG. 1 shows the locked condition.

The rotatable connection between the blade 1 and the handle 2 is made possible by means of a pin 17 which passes through the handle and the blade. The region at the pin 17 is referred to as the joint. That region is covered over relative to the exterior by a bow member 8 when the blade is in the folded-in condition. The bow member 8 thus serves as dust protection. The bow member 8 is connected on the one hand rotatably to the handle 2 at a pin 18. At the other end of the bow member, it is of such a shape that it extends as far as a slot 10 which is in the blade 1. A pin 11 on the bow member 8 extends into the slot 10. The pin 11 can thus be slid within the slot. That provides a slidable connection between the bow member 8 and the blade 1. In spite of the connection between the bow member 8 and the blade 1 the blade 1 still remains movable, that is to say it can be folded into and out of the handle.

Figure 2:
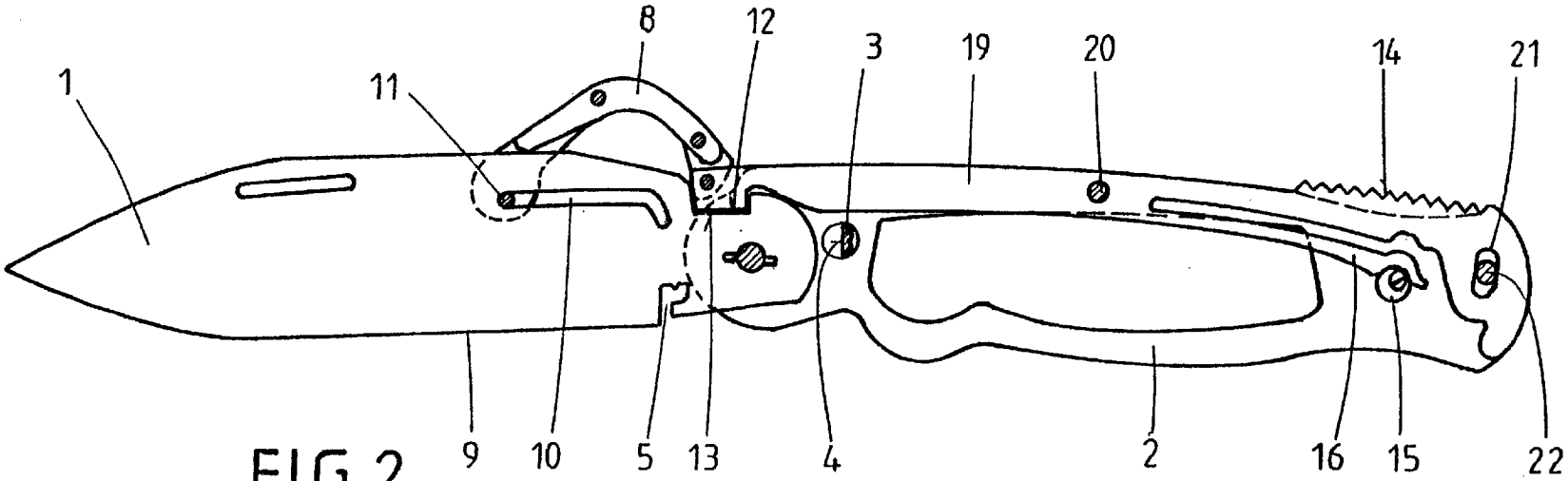
FIG. 2 shows the knife with the blade in an extended position.

FIG. 2 shows the knife with the blade in the folded-out or extended condition. The handle 2 and the blade 1 form substantially a straight line. A strip-shaped element 19 extends substantially along the handle 2. It represents a spring element. The strip-shaped element is rotatably connected to the handle 2 by way of a pivot 20. It extends from the open end of the handle to the end of the handle 2, at which the blade 1 is rotatably connected to the handle. At one end, the strip-shaped element 19 has a projecting blocking element 12. That blocking element engages into an opening 13 in the blade when the blade is completely opened out. In that way the blade 1 is arrested in the extended condition. By virtue of a suitably extending slot, the strip-shaped element 19 functions as a resilient element 16. That resilient element 16 presses against a pin 15 which is disposed in the proximity of the open end of the handle 2. The resilient element is biased in that situation. That provides that the projecting blocking element 12 is pressed by spring force into the opening 13 in the blade. The strip-shaped element 19 includes a serrated or notched region 14 which is accessible from the exterior. That region 14 serves as a button which has to be depressed in order to lift the blocking element 12 out of the opening 13 in the blade. The button 14 has to be depressed against the spring force of the resilient element 16. The pin 15 is provided with an opening. The resilient element presses against that opening of the pin 15. When the pin 15 is rotated the biasing effect of the resilient element 16 is adjusted in that way. It is thus possible to vary the force with which the button element 14 has to be depressed in order to unlock the blade in the extended condition.

A slot 21 is provided in the region of the open end of the handle, in order to guide the strip-shaped element 19. A pin 22 passes through the slot 21. That arrangement provides that the possible rocking movement of the strip-shaped element 19 about the pivot 20 on the one hand is guided and on the other hand is blocked in two end positions. One end position is reached when the pin 22 reaches an end of the slot 21.

The blade 1 has an opening 5. The opening 5 firstly goes into the blade substantially perpendicularly in order then to be continued towards the right. The pin 3 has an opening 4. At that location the pin 3 is of a substantially semicircular configuration in section. When the blade is folded into the handle the pin 3, in the region of the opening, in a suitable position, passes into the opening 5. When then the pin 3 is suitably rotated it passes into the region of the opening, which goes towards the right. The blade 1 is then blocked in the folded-in condition, as could already be seen from FIG. 1.

FIG. 2 shows the way in which the bow member 8 protrudes when the blade has been completely folded out of the handle. When the knife is held by the handle 2, the bow member 8 forms protection to prevent the thumb from slipping off in the direction of the blade. As the bow member 8 is markedly wider than the blade 1, the bow member is also markedly better suited as a support for a thumb in order thus to be able to press the blade forcibly in the direction of an article which for example is to be cut up. Particularly for optical reasons, the bow member 8 corresponds to the width of the handle. In order to form a good support, it is however sufficient for the bow member to be only substantially wider than the blade 1. It will be appreciated that the bow member may also be wider than the handle.

Figure 3:
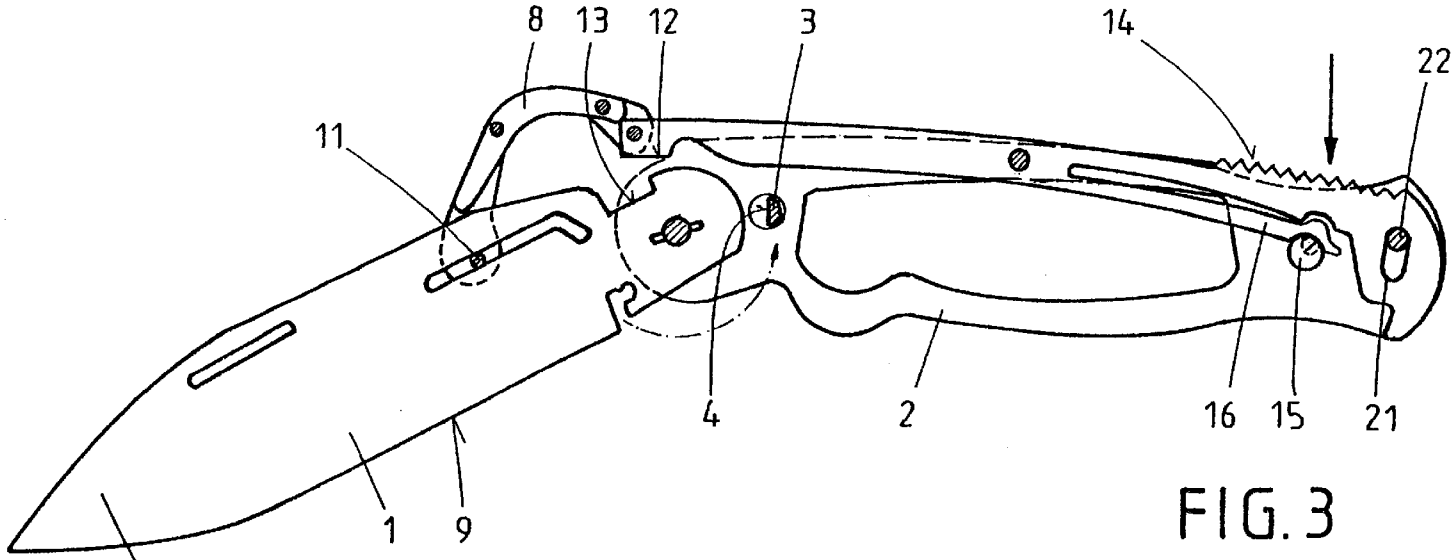
FIG. 3 shows the knife pivots toward the closed position.

FIG. 3 shows depression of the button 14. In that way the pin 22 finally arrives at an end of the slot 21. The button 14 cannot then be depressed further. The blocking element 12 is in that way lifted out of the opening 13 in the blade 1. The blade 1 can then be pivoted in the direction of the handle 2. That is effected for example by pressing against the bow member 8.

FIG. 3 clearly shows how the resilient element 16 can now be biased more strongly, in comparison with the situation shown in FIG. 2. The button 14 thus had to be depressed against the spring force of the resilient element 16. In that case, the pin 15 is so rotated that the biasing force of the resilient element 16 is virtually at a maximum. If the pin 15 is rotated through about 180°, the region of the opening moves downwardly. The resilient element 16 is correspondingly relieved of stress. The force which is to be applied to depress the button 14 is correspondingly reduced.

Figure 4:
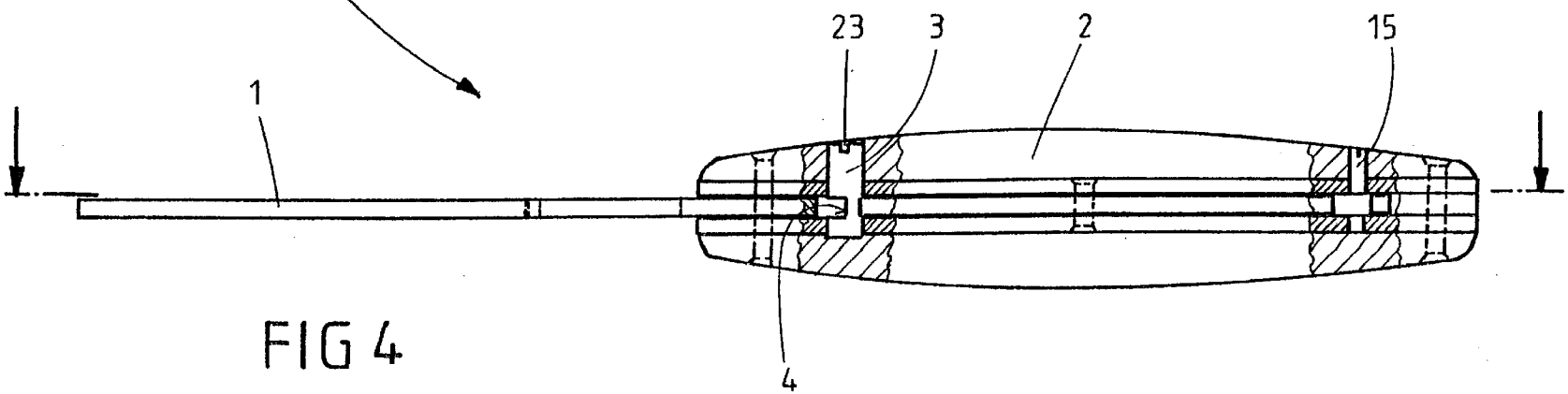
FIG. 4 shows a cross-sectional view of the knife.
Figure 5:
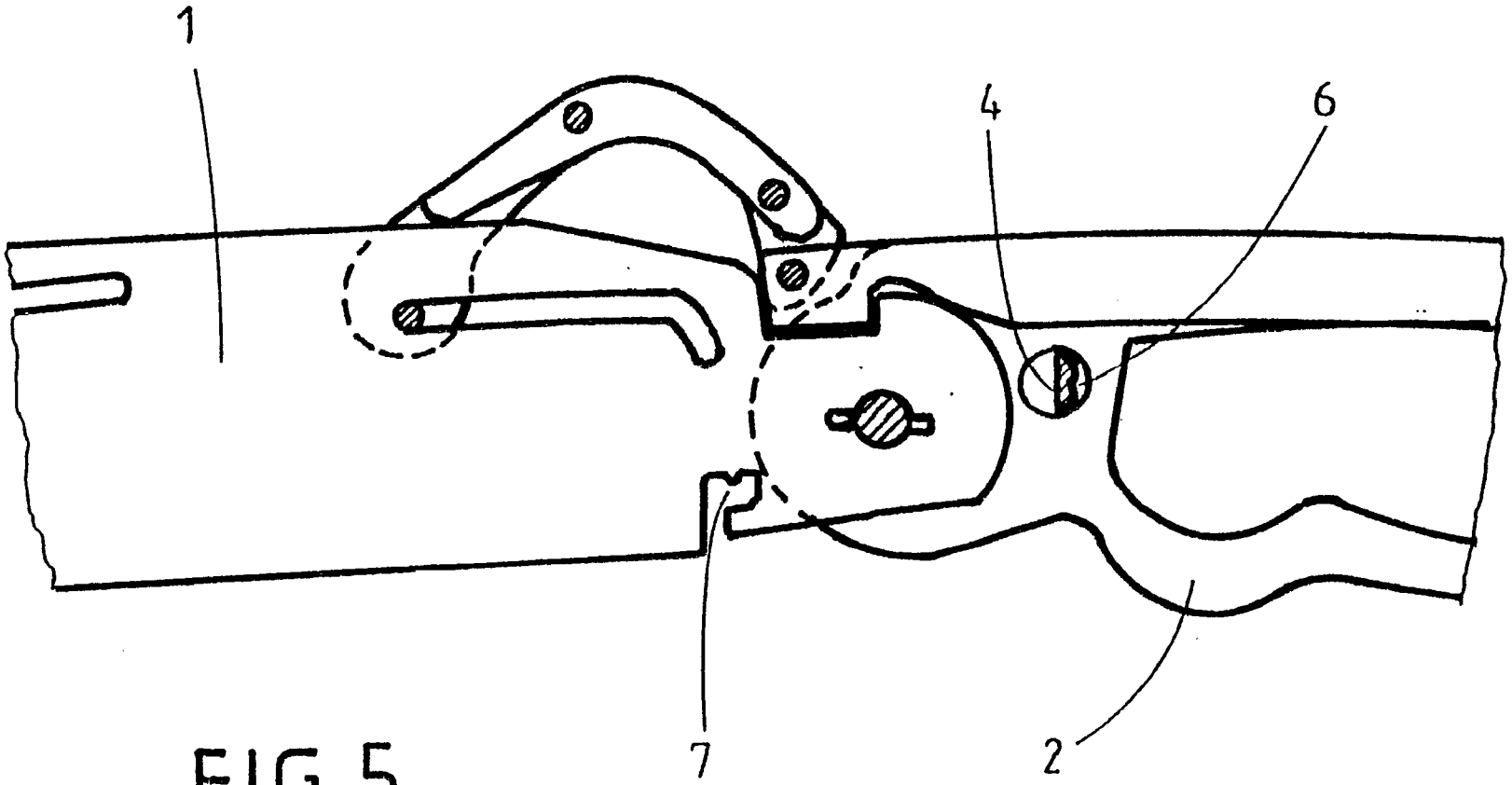
FIG. 5 shows a close-up view of a section of the knife.

FIG. 4 shows a section through the knife with the blade 1 and the handle 2, so that in particular the pins 3 and 15 are shown in the sectional view. The pin 3 is a pin which serves for child-proofing. It is accessible from one side of the handle, but it is sunk or recessed in the handle so that it does not project from the handle. The pin 3 has a slot 23, being accessible from the exterior. A coin can be fitted into that slot to rotate the pin 3.

The pin 15 which serves as the adjusting element for the resilient element 16 is designed in the same manner. The pin 15 is also sunk or recessed in the handle so that it does not project therefrom. It is accessible from one side of the handle. As viewed from the accessible side, it has a slot into which a coin can be inserted. The pin 15 can thus be rotated by means of a coin in order to adjust the button pressure which is required for depressing the button 14.

What is claimed is:

1. In a knife having a blade (1) with a cutting edge (9), which blade is rotatably connected to a handle (2) for hinged movement into and out of the handle (2), and a locking means by which the blade (1) is selectively locked or unlocked when the blade (1) is moved into the handle (2), the improvement wherein the locking means is recessed in the handle and includes a locking pin (3) which is mounted for rotation in the handle (2) of the knife and which is accessible from the exterior of the knife by means of an auxiliary tool, the inner end of the pin (3) has a first contoured surface (4), the blade (1) has a second contoured surface (5), whereby movement of the blade (1) into the handle (2) causes the first contoured surface (4) of the pin to engage and lock the contoured surface (5) in the blade, and whereby rotation of the pin (4) with respect to the second contoured surface (5) unlocks the blade.

2. A knife according to claim 1 including a fixing means which sufficiently retains the pin (3) that for unlocking purposes a force must be applied, which is greater than the force which is required to be applied to rotate the locking pin.

3. A knife according to claim 2 wherein the fixing means comprises a groove (6) and a tongue (7), wherein the tongue engages into the groove when the blade (1) is folded into the handle (2) and locked.

4. A knife according to claim 1 wherein the locking pin has an exposed slot (23) adapted to receive the auxiliary tool for rotating the pin (3).

5. A knife according to claim 1 including a bow member (8) which is rotatably connected to the handle (2) and slidably connected to the blade (1), wherein when the blade is folded into the handle, the bow member (8) covers one end of the knife and when the blade is folded out of the handle, the bow member protrudes on the side of the knife opposite to the cutting edge (9).

6. A knife according to claim 5 including a slot (10) in the blade (1), in which a pin (11) of the bow member (8) is guided, whereby a slidable connection between the bow member (8) and the blade (1) is established.

7. A knife according to claim 6 wherein the maximum width of the bow member (8) substantially corresponds to the width of the handle (2).

8. A knife according to claim 7 wherein there is provided a depressible button (14) and supplementary locking means (12, 13) by which the blade (1) is locked in an extended condition, and wherein unlocking is effected by pressing said button (14), wherein there is provided an adjusting means by which the force required to effect unlocking of the blade in the extended condition is adjustable.

* * * * *